United States Patent [19]

Mancini

[11] 4,356,682

[45] Nov. 2, 1982

[54] COUNTING MECHANISM FOR CREAMER FILLING MACHINE

[75] Inventor: Derek V. Mancini, Markham, Canada

[73] Assignee: Consumers Glass Company Limited, Etobicoke, Canada

[21] Appl. No.: 175,320

[22] Filed: Aug. 4, 1980

[51] Int. Cl.[3] ..... B65B 35/44

[52] U.S. Cl. ..... 53/443; 53/501; 53/542; 53/244

[58] Field of Search ..... 53/443, 448, 154, 475, 53/244, 542, 250, 55, 58, 501; 198/431, 433, 425, 426, 420, 424

[56] References Cited

U.S. PATENT DOCUMENTS

| | | | |
|---|---|---|---|
| 2,590,823 | 3/1952 | Rhodes | 53/244 X |
| 2,648,421 | 8/1953 | Vitz | 198/433 |
| 2,951,574 | 9/1960 | Craig | 198/433 X |
| 3,179,231 | 4/1965 | Craig | 198/433 X |
| 3,308,922 | 3/1967 | Ellis et al. | 198/433 |
| 3,429,416 | 2/1969 | Provost et al. | 198/433 |
| 3,557,932 | 1/1971 | Laub | 198/433 X |
| 3,890,764 | 6/1975 | Hartman | 53/542 X |
| 3,952,855 | 4/1976 | Rogers | 198/431 |
| 4,030,268 | 6/1977 | Payne | 53/244 X |
| 4,228,901 | 10/1980 | Watzka et al. | 198/426 X |

*Primary Examiner*—Horace M. Culver

[57] ABSTRACT

The specification of the present application discloses an apparatus and method for dividing the multiple parallel output of a multi-lane container packaging machine to allow bulk packaging of a number of containers independent of the number of containers in one parallel output. This is accomplished by changing the parallel container output into a series output in which the container spacing and position relative to other containers is determined by the output rate of the multi-lane packaging machine and the speed of a second conveyor positioned at the discharge of the machine to change the parallel input of containers to a series format. A segmenting means is associated with the indexing of the multi-lane packaging machine and divides the time between successive indexes into divisions representative of the number and spacing of containers on the second conveyor. These divisions are then used to determine when a specified number of containers have been bulk packaged, at which time the series output of containers is interrupted in preparation for loading another bulk container.

12 Claims, 5 Drawing Figures

COUNTING MECHANISM FOR CREAMER FILLING MACHINE

FIELD OF THE INVENTION

The present invention relates to the division of the output of a multi-lane container packaging machine where it is desired to package the output of such machine in numbers independent of the size of the parallel output. In particular, the present invention relates to an apparatus and method for dividing the multiple output of a container packaging machine in a simple and efficient manner to allow bulk packaging of any number of products.

BACKGROUND OF THE INVENTION

In the past, multi-lane container packaging machines have been used for packaging such products as individual portion sized condiments, creamers and other dairy products. Because of the small size of these containers, the products are usually packaged in bulk with perhaps 100 or 200 individual containers to a package or of a size specified by the end purchaser. These products have rapidly increased in consumer acceptance and therefore, the volume produced in a given year has greatly increased. To keep pace with this rapid growth, slightly larger capacity multi-lane packaging units have replaced older units. However, when the number of lanes of these packing machines does not evenly divide into the number of products to be bulk packaged, difficulties arise. The obvious answer to this dilemma is to provide a counting mechanism downstream of the output of the packaging machine to accurately control the loading of the product. However, difficulties are encountered due to the container's small size, the requirement for the container to be properly oriented to be processed through a counter as well as the increased floor space, such a mechanism would require.

The present invention seeks to mitigate these problems by providing a simple apparatus which can be secured downstream of the packaging machine which does not require accurate orientation of the product output and utilizes the precise control of the parallel output of the packaging machine to determine when an appropriate number of containers have been deposited in a carton.

The spread of these individual container packaging machines and particularly when the machine is designed to fill creamers, is quite fast with one lane of the conveyor producing approximately 100 creamers per minute. As can be appreciated, this rapid flow of product creates additional problems in designing a simple system which allows packaging of any number of containers in bulk independent of the parallel output of the container packaging machine.

SUMMARY OF THE INVENTION

An apparatus for dividing the multiple parallel output of a container packaging machine having an intermittent conveyor movement which is indexed in accordance with the packaging operation, according to the present invention, allows bulk packaging of a number of containers independent of the number of containers in one parallel output of such container packaging machine. The apparatus comprises a second conveyor positioned to receive the parallel output of such container packaging machine and space such containers along the length thereof. The second conveyor is driven at a speed sufficient to produce a series format of containers along the conveyor and means associated with the indexing of such container packaging machine for dividing the time between successive indexes of such machine into divisions representative of the number and spacing of such containers on said continuous conveyor, is provided. The apparatus further includes interrupting means for segmenting the series container output of said second conveyor in accordance with the divided index time independent of the number of containers fed to said second conveyor in parallel format.

The method according to the present invention is used to divide the multiple parallel output of a container packaging machine having intermittent conveyor movement which is indexed in accordance with the packaging operation. It is used for dividing the multiple parallel output of containers from the machine. The method comprises the steps of loading the parallel output of the container packaging machine onto a second conveyor positioned to space such containers along the length thereof, driving the second conveyor in association with the drive of the container packaging machine, at a speed sufficient to provide a series format of containers along said second conveyor, dividing the index time into divisions representative of the number and spacing of containers on the second conveyor and interrupting the series format in accordance with the divided index time to segment the output of the second conveyor, independent of the number of containers fed to said second conveyor in parallel format.

The method and apparatus according to the present invention utilizes the precision of the parallel output of the packaging machine in combination with a means for dividing the parallel output into smaller groups more suitable for packaging. Furthermore, the parallel output is transformed into a series format such that the means for dividing the product into smaller groups may be used to segment this series format when an appropriate number of containers have been bulk packaged. Thus it can be appreciated that according to the present invention, the precision of the indexing of the multi-lane packaging machine is tied with a second conveyor to provide a system which can be used to interrupt the series output of the second conveyor.

The requirement for additional floor space is greatly reduced with this system and the system can easily be added to existing machines should bulk packaging sizes change. Furthermore, according to a preferred aspect of the invention, the conveyor is continuously driven and is associated with the drive of the multi-lane packaging machine, such that interruptions or accelerations, or decelerations, of the multi-lane packaging machine are accounted for by the appropriate subsequent reaction of the continuously driven conveyor.

In addition to the minimal space requirements of the present system, and the adaptability of this system to existing machines, the system is essentially mechanical and therefore, reliable. Furthermore, the system requires little operator care due to its simple operation.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
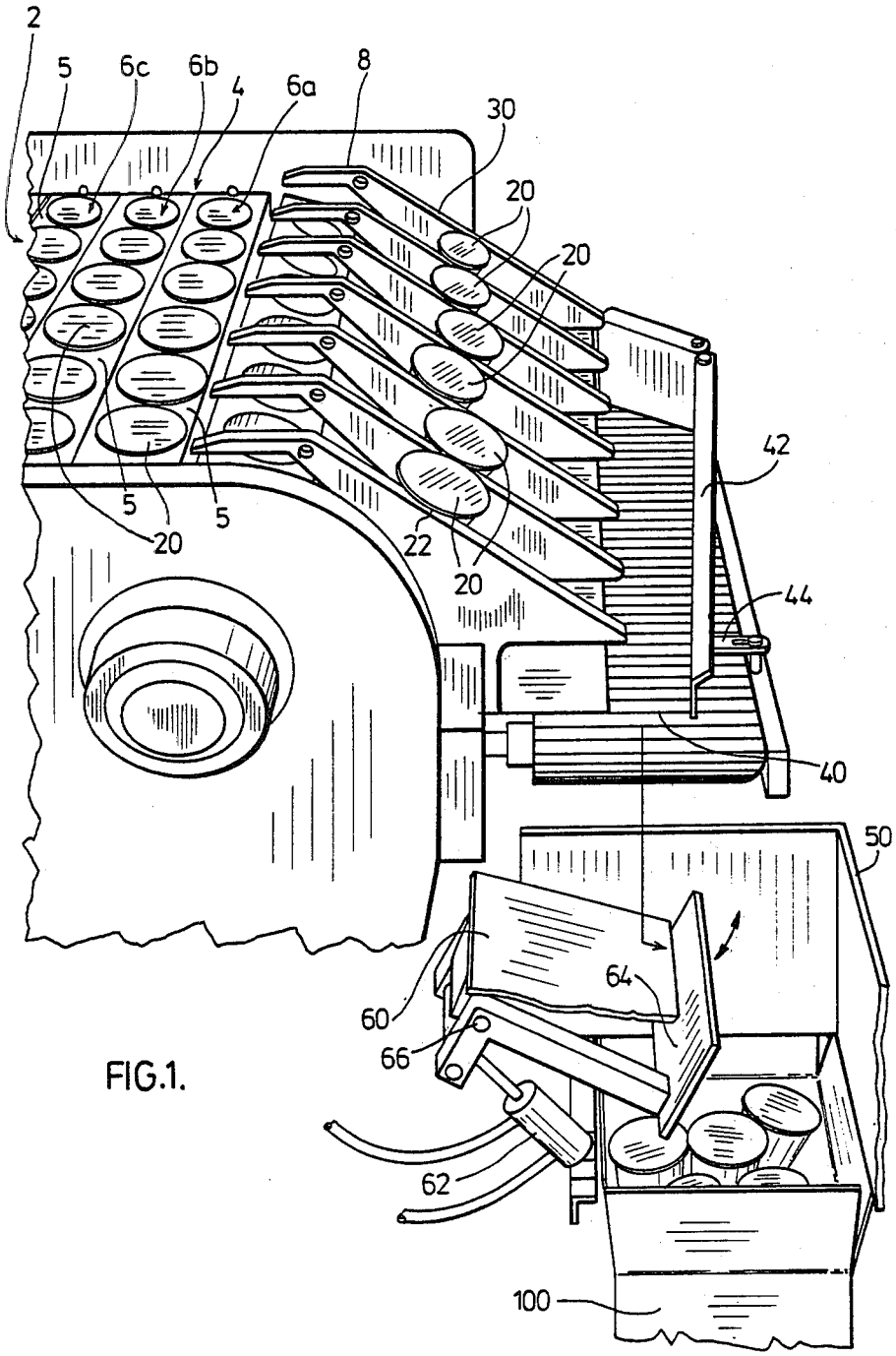
FIG. 1 is a perspective view of the output of a multi-lane container packaging machine in combination with a second conveyor provided with a chute for packaging of the product into cartons.

A container packaging machine 2, in FIG. 1, has been adapted for use in packaging small portion sized creamers 20, which are nested within the intermittent movement conveyor 4. Guide rails 8 are provided at the discharge of the packaging machine for engaging the flange 22 of individual containers and removing the containers from the conveyor. The conveyor has been provided with a number of plate members 5 which nest the containers in parallel format generally shown individually as 6*a*, 6*b* and 6*c* in FIG. 1. Thus it can be appreciated that the output of the multi-lane filling machine is simultaneously discharged in parallel format down the guide rails 8 and loaded onto the second conveyor 40.

Conveyor 40 is positioned to receive the parallel output of the multi-lane packaging machine and move this output in series format towards the packaging carton 100. Conveyor 40 is preferably continuously driven in contrast to the intermittent movement of conveyor 4 and the speed of the conveyor is set in accordance with the discharge rate of the packaging machine to ensure the output of the conveyor 40 is essentially a queue of containers which is dumped onto the chute member 60 and subsequently bulk packaged in carton 100. Associated with the conveyor 40 is a rail 42 for ensuring the discharge of the packaging machine remains on the conveyor. This conveyor is of a corrugated rubber type to minimize movement of the loaded containers and thereby urge the containers to remain in non-overlapped relationship. Associated with rail 42 is an adjusting member 44 which if desired, can be angled relative to the conveyor to adjust the position of the containers on the conveyor. Furthermore, it can be appreciated that the orientation of the containers on conveyor 40 will not be constant for example, the containers may be lying on their sides, base or lids and in fact, the orientation will be quite random. However, the spacing of the containers along the length of the conveyor can be approximated with a fair degree of accuracy.

The lever member 64 in combination with the double acting pneumatic cylinder 62 is used to interrupt the packaging of the containers into carton 100. The lever member is pivotted about axis 66 and retraction of cylinder 62 causes member 64 to interrupt the flow of the product off chute member 60, thereby, allowing a new carton to be positioned below. Because the product output of conveyor 40, is in series format, the containers fall off chute 60 in essentially single file and therefore, the lever member can segment this flow quickly and accurately.

As can be appreciated, with respect to the discussion of FIG. 1, the method and apparatus according to the present invention requires that the parallel output of the multi-lane filling machine be changed to series format which can be interrupted accurately. To provide this series format, conveyor 40 is driven at a sufficient speed such that the parallel output of the machine 2 has been advanced past the discharge area prior to the subsequent parallel output being loaded on the conveyor. It is preferred that the conveyor 40 be driven in association with the drive of the packaging machine 2 and at a speed to provide a essentially continuous output of equally spaced containers. However, the system can still function should conveyor 40 be driven at a higher speed such that gaps exist in the output of conveyor 40 between parallel outputs of the packaging machine.

Figure 2:
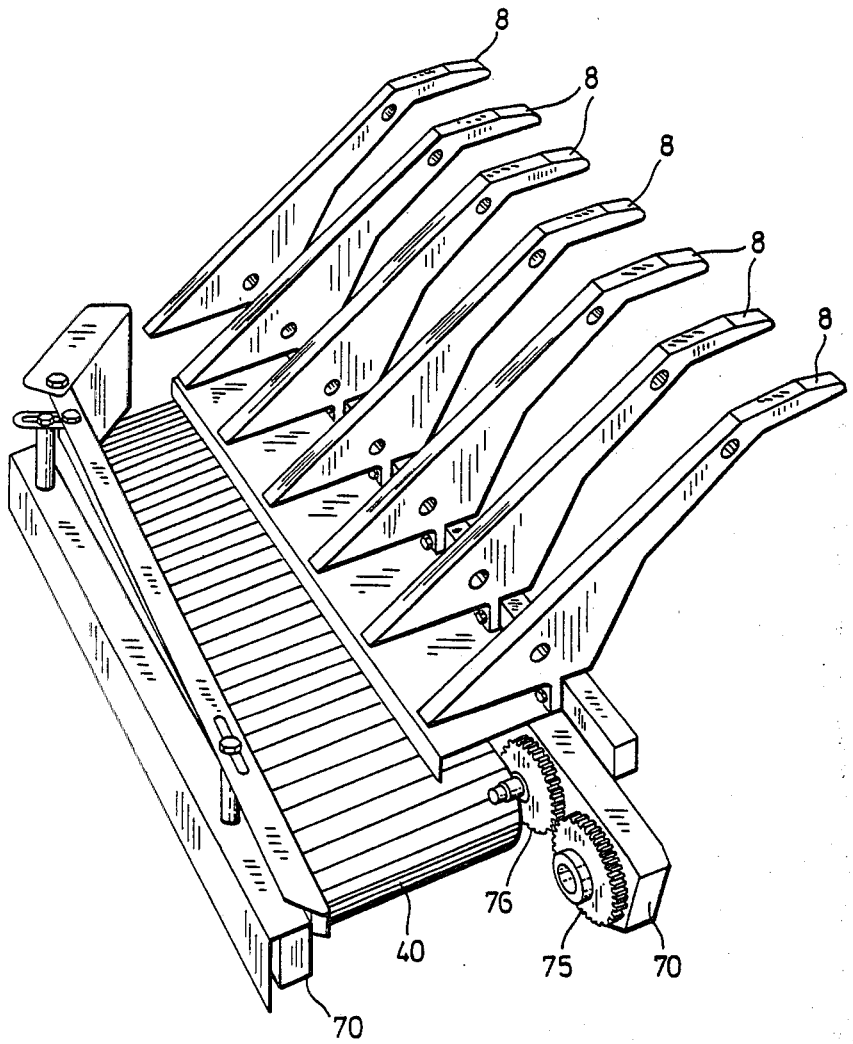
FIG. 2 is a top perspective view showing the second conveyor of the present invention.
Figure 3:
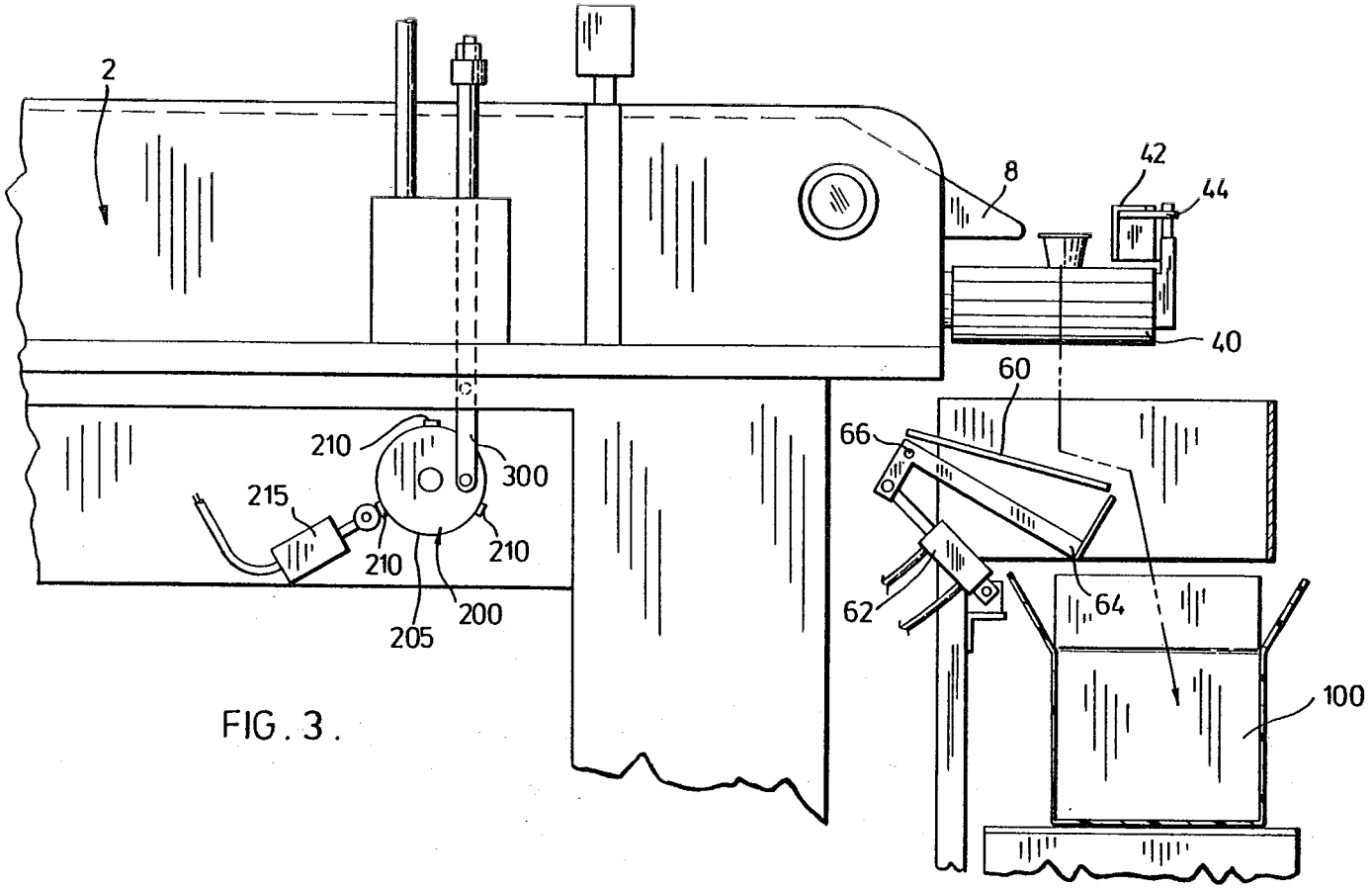
FIG. 3 is a side view of showing the second conveyor and chute as well as means associated with the indexing of the conveyor of the multi-lane packaging machine.

From FIG. 2 it can be appreciated that this apparatus can easily be added to existing machines as the guide rails 8 which define chutes for loading the containers onto the conveyor 40 can be secured directly to the support structure 70 such that the guide rails and conveyor 40 may be sent as a unit. Furthermore, it can be seen that the conveyor can be driven by gears 75 and 76 with an input shaft associated with gear 75 for driving thereof. This input shaft can be a takeoff from the continuous drive of the packaging machine which is subsequently processed to produce the intermittent movement of the conveyor 4. By mechanically coupling the gear 75 to the drive of the intermittent conveyor, changes in speed of the packaging machine as well as stoppages are reflected in the speed of the conveyor 40, thereby providing a system that is not sensitive to variations of the output rate of the packaging machine.

Up to this point, it can be seen that the parallel output of the multi-lane filling machine may be adapted to provide a series of containers which can easily be interrupted during the packaging of the product. However, no mechanism has yet been disclosed for providing a simple mechanism for dividing this product and controlling the interruption of the flow of products by lever 64. It can be appreciated that the cycle time of the container packaging machine 2 and the driven speed of conveyor 40, determine the spacing between sequential parallel outputs of the machine 2. It is possible to drive conveyor 40 at a speed sufficient that products have cleared the discharge area of machine 2, just prior to loading of a subsequent parallel output of the multi-lane machine such that the spacing of containers in the series output is essentially constant.

In order to break this series output of containers, into groups independent of the output size of the packaging machine, a mechanism 200 is provided on the packaging machine which is driven from the continuous drive of the packaging machine 2 whereby one full revolution of the disc 205 corresponds to one full cycle of the machine. Three magnets 210 have been equally spaced about the periphery of disc 205 and correspond to product groups of two containers in the series output of conveyor 40, when the parallel output of the packaging machine has 6 containers. A reed switch 215 is secured near the periphery of disk 205 and is used to detect the passage of magnets 210 during the revolution of disc 205. Depending on the desired result, the signal of switch 215 may be set to a counter and the series output of conveyor 40 interrupted at a predetermined value which would correspond to the number of containers to be bulk loaded. Once this predetermined value has been reached, cylinder 62 is activated causing lever 64 to interrupt the flow of product into carton 100.

The location of mechanism 200 on the multi-lane packaging machine is not critical, however, during set up of the machine the first carton packaged may not have the desired number of containers. This is caused by a fixed time delay between the containers mechanism 200 is recognizing and those being loaded into the carton. However, because this is a fixed error and subsequently, loaded cartons will have the correct number of containers. This does not present a problem as often, the machine has to be adjusted during set up to obtain the proper operating conditions and therefore, the containers of at least the first carton are reprocessed or scrapped.

In the case where conveyor 40 is driven at a higher speed such that gaps exist in the series output of containers due to the time delay in loading a subsequent output from the multi-lane machine, the position of the magnets 210 on disc 205 may be adjusted to account for the gaps within the series output, while still reflecting the position of the containers. Therefore, it can be appreciated that detection means 200 provides a simple manner for creating a signal from the multi-lane packaging machine which can be used to segment the series output of conveyor 40 thereby allowing bulk packaging a number of containers, independent of the value of the number of lanes of the packaging machine.

Figure 4:
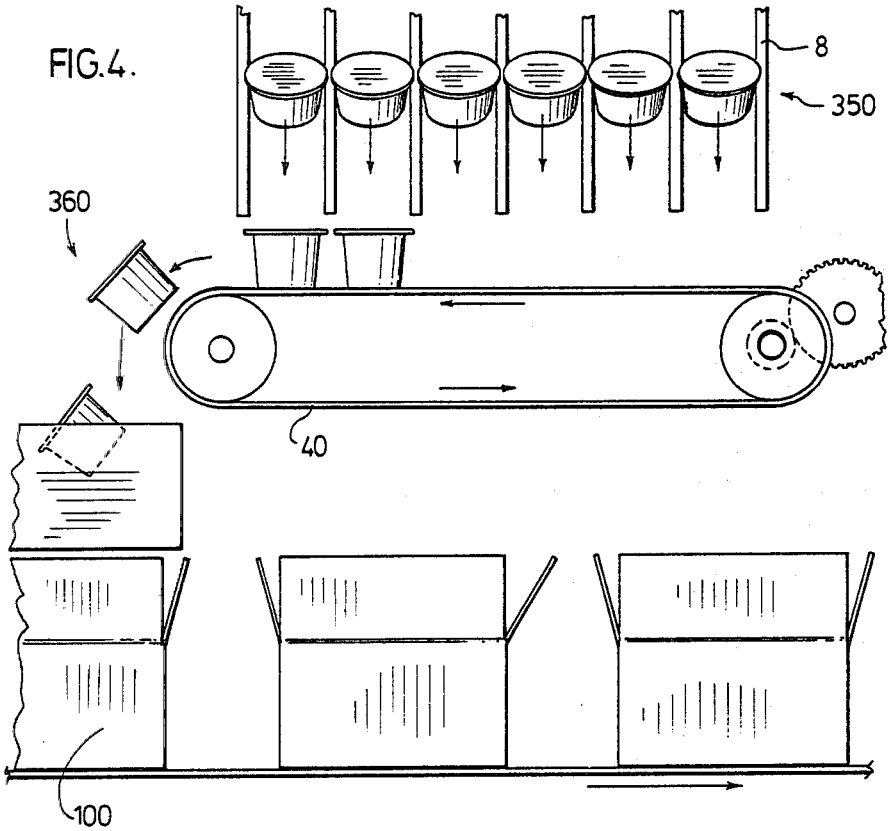
FIG. 4 is a front view showing the second conveyor and packaging system.

The relationship between the movement of conveyor 40 and one parallel output of the packaging machine 2 is shown in FIG. 4 wherein one parallel output generally shown as 350 of the multi-lane machine is progressing down rails 8 and the series output generally shown as 360 is being advanced by conveyor 40 into the bulk carton 100. Parallel output 350 has progressed about half way down the rails 8 and will subsequently be loaded on conveyor 40. The last products of the series output 360 are being advanced on conveyor 40 and will clear the discharge area of guide rails 8 prior to the parallel output 350 being loaded. The containers have been shown upright on conveyor 40 however, in actual practice, they may indeed not have this orientation. However, the output of conveyor 40 will still be in series format and the orientation of the containers is not critical.

As can be appreciated when a predetermined number of containers have been loaded into a carton 100, lever 64 will be activated interrupting the series output of conveyor 40, and allowing a subsequent carton to be positioned below chute 60. By interrupting the series output and allowing the product to accumulate on chute 60, the packaging machine 2 need not be interrupted thereby providing a highly efficient system.

Figure 5:
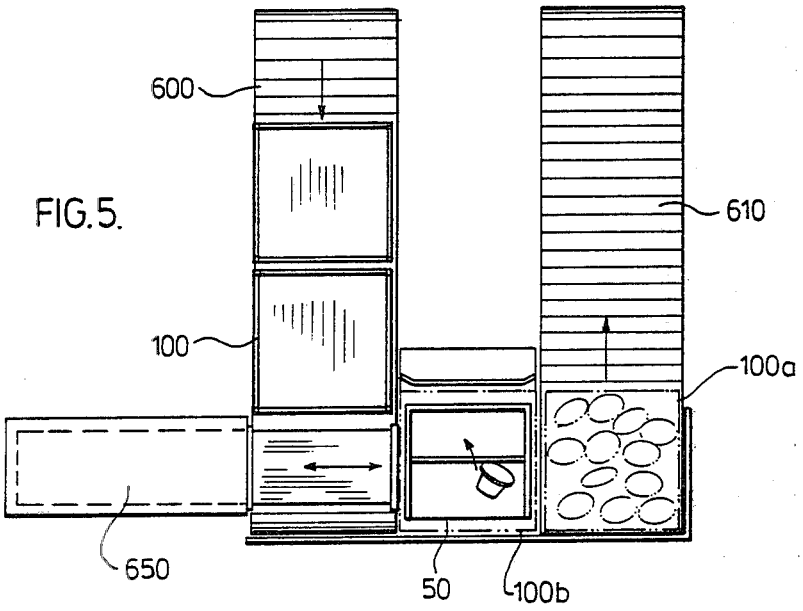
FIG. 5 is a top view of a carbon feed system which can be used in conjunction with the present invention for interrupting a series output of the second conveyor.

A slightly different arrangement is shown in FIG. 5 wherein an empty carton feed conveyor 600 is used to advance empty cartons and position them in preparation for loading of containers. A piston advance 650 is used to quickly position an empty carton beneath loading chute 50 when a predetermined number of containers have been loaded. As shown, a carton 100A was directly beneath chute member 50 however, after receiving an appropriate number of products, the carton advance 650 is activated thereby forcing carton 100A from beneath chute member 50 and positioning carton 100B beneath the chute. It can be appreciated that the movements of carton 100A and 100B in response to the advancement of piston member 650, cause the series output of conveyor member 40 to be segmented with first segment loaded into carton 100A and the second segment loaded into carton 100B. Conveyor 610 subsequently removes carton 100A which can be closed and prepared for shipping. With this type of arrangement, lever 64 in combination with cylinder 62 is not required as the carton feed is such that the movement of the carton segments the series output of the conveyor and there is no need to accumulate creamers on chute 60.

The present invention has been described with respect to a six lane packaging machine in which the required number of containers bulk packaged was a multiple of 2. However, this system can be adapted for any size of multi-lane packaging machine and can also be adapted to divide the series output into smaller groups. For example, if it was desired to distinguish each container in the series output, 6 magnets could have been provided on disc 205. However, due to the particular application, of this system, that being creamers, where the output rate of the machine is very fast, this high precision is not required as an error is of plus or minus, one container can still occur. This error is caused due to the interruption means inability to precisely divide the output. It can be appreciated that once the lever is activated, the upward movement could strike a container which may fall within the carton or it may return to the chute member 60. However, in bulk packaging of creamers this is not a critical problem as the trade can readily accept this error as long as the average number of containers per package is what is specified.

With a six lane creamer machine, it is not possible to simply package 100 creamers to a container which is the commonly requested bulk container size. However, with the present mechanism, this can be easily executed by merely activating the interruption means when the counter has reached 50. Without this apparatus, the creamers would have to be fed through a prior art counting machine which requires quing of products and proper orientation of the products. These prior art systems, also require increased floor space and fail to utilize the information available from the multi-lane machine.

The present system provides a reliable, mechanical system for controlling the approximate number of containers bulk packaged and can easily be adapted to existing machines. Furthermore, because it utilizes the information already available from the multi-lane machine, it is inexpensive to produce and provides a low cost alternative to more complicated counting mechanisms. Furthermore, its simple operation requires little operator supervision once the machine is running.

Although the invention has been described herein in detail, it will understood by persons skilled in the art that variations may be made thereto, without departing from the spirit of the invention or the scope of the appended claims.

The embodiments of the invention in which an exclusive property or privilege is claimed are defined as follows:

1. An apparatus for dividing the multiple parallel output of a container packaging machine having an intermittent conveyor movement which is indexed in accordance with the packaging operation to allow bulk packaging of a number of containers independent of the number of containers in one parallel output of such container packaging machine comprising a second conveyor positioned to receive the parallel container output of such container packaging machine and space such containers along the length thereof, said conveyor being driven at a speed sufficient to produce a series format of containers along said conveyor; means associated with the indexing of such container packaging machine for dividing the time between successive indexes of such machine into divisions representative of the number and spacing of containers on said second conveyor and interrupting means for segmenting the series container output of said second conveyor in accordance with the divided index time independent of the number of containers fed to said second conveyor in parallel format.

2. A method for dividing the multiple parallel output of a container packaging machine having a conveyor which is indexed comprising the steps of (1)loading the parallel output of the container packaging machine onto a second conveyor positioned to space such containers along the length thereof; (2)driving the second conveyor in association with the drive of the container packaging machine at a sufficient speed to provide a series format of containers along said second conveyor; (3)dividing the index time into divisions representative of the number and spacing of containers on said second conveyor; and (4)interrupting the series format of containers in accordance with the divided index time to segment the output of said second conveyor independent of the number of containers feed to said second conveyor in parallel format.

3. A method as claimed in claim 2, wherein said second conveyor is continuously driven in association with the drive of said multi-lane packaging machine.

4. An apparatus as claimed in claim 1, wherein said second conveyor is continuously driven in association with the drive of said multi-lane packaging machine and including totalizing means for counting the divisions representative of the number of containers processed.

5. An apparatus as claimed in claim 4, wherein said second conveyor is associated with the drive of said multi-lane packaging by a mechanical coupling.

6. An apparatus as claimed in claim 4 or 5, wherein said second conveyor has a corrugated rubber belt which reduces movement of containers on the belt.

7. An apparatus as claimed in claim 4, wherein said interrupting means includes a chute positioned at the discharge of said second conveyor and a lever for obstructing the flow of product off said chute when activated by a piston means.

8. An apparatus as claimed in claim 7 wherein said piston means is activated in response to said totalizing means.

9. An apparatus as claimed in claim 4, wherein said interrupting means includes a bulk carton advance system which interrupts the series output of said second conveyor by rapid advancement of a subsequent bulk carton in response to said totalizing means.

10. A method as claimed in claim 3, further including totalizing the divisions of the index time and segmenting the output of said second conveyor at a predetermined value of the totalized divisions.

11. A method as claimed in claim 10, wherein interrupting of the series format of containers includes moving a lever to accumulate containers during the subsequent advancement of an empty bulk container from loading.

12. An apparatus as claimed in claim 1, 4 or 7 wherein, said means associated with the indexing of such container packaging machine includes a disc driven by the continuous drive of such packaging machine such that one revolution of said disc corresponds to one indexing of the machine, said disc having a number of magnets spaced about the periphery thereof in a manner determined by the speed of said second conveyor and said packaging machine, and a switch means associated with said disc to detect the passage of a magnet past said switch to provide a signal which may be used to determine the number of containers packaged.

* * * * *